US008191724B2

(12) United States Patent
Licata

(10) Patent No.: US 8,191,724 B2
(45) Date of Patent: Jun. 5, 2012

(54) SPEEDY BAG—BAG DISPENSING SYSTEM

(76) Inventor: Jack Joseph Licata, Bernardsville, NJ (US)

( * ) Notice: Subject to any disclaimer, the term of this patent is extended or adjusted under 35 U.S.C. 154(b) by 328 days.

(21) Appl. No.: 12/685,667

(22) Filed: Jan. 11, 2010

(65) Prior Publication Data

US 2011/0011871 A1 Jan. 20, 2011

Related U.S. Application Data

(63) Continuation-in-part of application No. 11/140,178, filed on May 31, 2005, now Pat. No. 7,669,728.

(60) Provisional application No. 61/207,831, filed on Feb. 18, 2009.

(51) Int. Cl.
*B65D 1/06* (2006.01)

(52) U.S. Cl. ..... 220/495.07; 206/397; 206/395

(58) Field of Classification Search ..... 220/495.07; 206/397, 395, 390, 389; 221/186
See application file for complete search history.

(56) References Cited

U.S. PATENT DOCUMENTS 2,435,093 A * 1/1948 Mitschrich ..... 242/444.5
3,702,672 A * 11/1972 Becht ..... 225/106
3,792,770 A * 2/1974 Freeman ..... 242/160.4
3,800,503 A * 4/1974 Maki ..... 53/390
5,642,812 A * 7/1997 Hale ..... 206/396
5,713,469 A * 2/1998 Buscema ..... 206/396
7,669,728 B2 * 3/2010 Licata ..... 220/495.01
2007/0215622 A1 * 9/2007 Perez ..... 220/495.07

* cited by examiner

*Primary Examiner* — Stephen Castellano
(74) *Attorney, Agent, or Firm* — Harold G. Furlow, Esq.

(57) ABSTRACT

A bag dispensing apparatus is described that comprises a container that includes a box and a series of bags. The box includes a plurality of walls that define an approximately rectangular enclosure. One of the walls defines a restricted opening. The box includes opposing walls and two of said opposing walls include connectors. A core is attached to the connectors of the container. The connectors provide for the rotational movement of the core relative to the box. The core comprises a number hingedly connected plates that are biased to a first position. The series of bags are connected in sequence and sequentially removable through the opening in the box. The core receives and connects to the terminal end portion of a last bag of the series of bags. A line of weakness is constructed between each pair of adjacent bags to permit ease of separation between adjacent bags. A first position of the last bag includes that the attachment of the last bag and core removes the container with the last bag when the last bag is removed from the trashcan. The last bag is optionally movable to a second position that includes separating the last bag from the container. Once the container is separated from the last bag, the container is suitable for refilling with the series of bags.

12 Claims, 12 Drawing Sheets

FIG 5
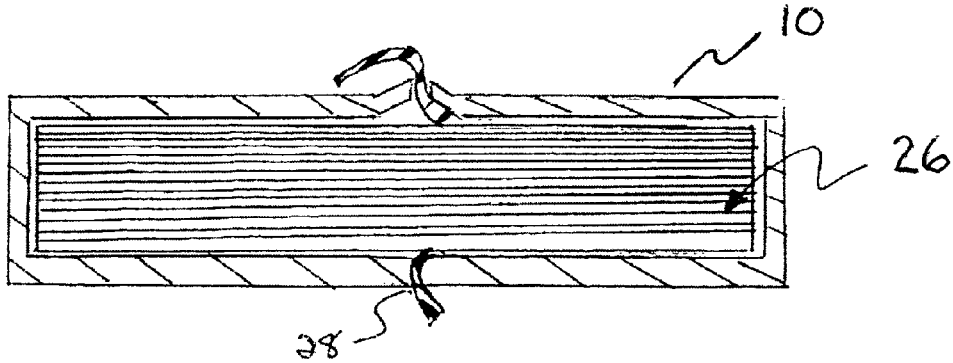
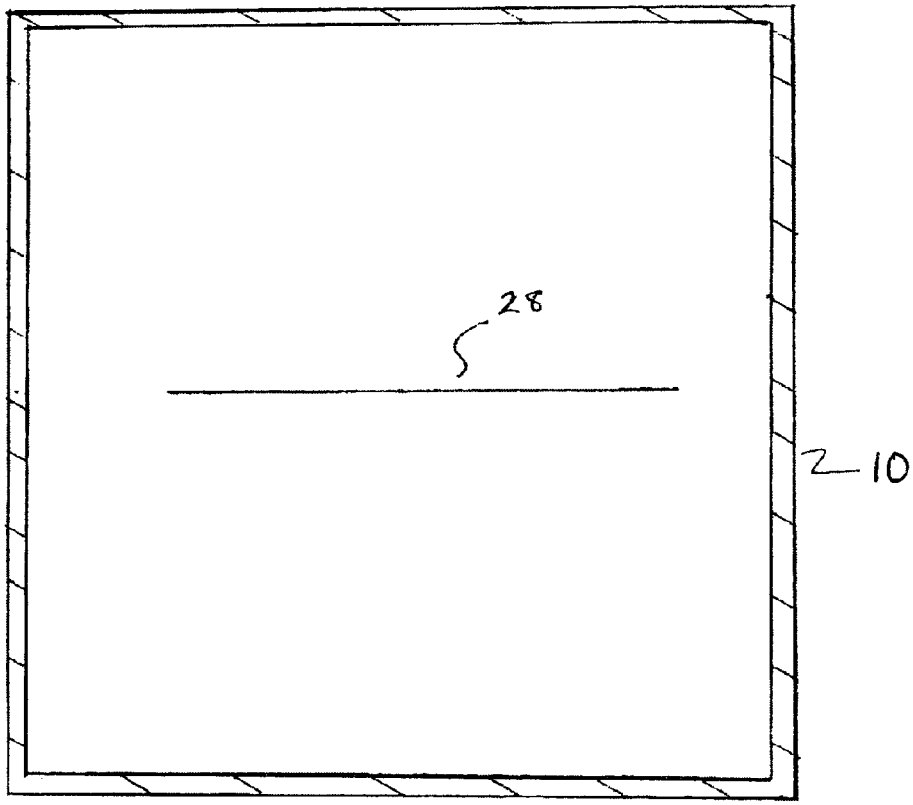
FIG 6

SPEEDY BAG—BAG DISPENSING SYSTEM

CROSS-REFERENCE TO RELATED APPLICATIONS

This application is a continuation in part of and claims priority to U.S. application Ser. No. 11/140,178 filed on May 31, 2005 now U.S. Pat. No. 7,669,728 and claims priority to and the benefit of provisional application 61/207,831 filed Feb. 18, 2009 and, the disclosures of which are incorporated by reference herein and made a part of this application.

BACKGROUND OF THE INVENTION

1. Field of the Invention

This disclosure relates to structures that dispense bags and in particular to a structure that can dispense bags from a bottom of a trash receptacle.

2. Description of the Related Art

Trash bags are mainly used to line a trashcan type receptacle. The problem is the liners are never near the receptacle and someone has to retrieve a liner from a remote location to complete the function, too much time and too many man hours are wasted in this process.

Many people in a residential or commercial application will store several extra bags in the bottom of the trashcan receptacle as a means to speed up the entire cycle of changing trashcan liners. In an industrial cleaning, health care, or fast food application the time and cost factor for this process is significant.

Many times this job has been delegated to people with handicaps or mental illness. A more efficient, easier, cleaner, and less cumbersome way of having these bags readily available has been needed for some time.

SUMMARY OF THE INVENTION

The present disclosure describes a system or apparatus which is convenient and economical for packaging, deploying, and distributing plastic bags, primarily, but not exclusively in the waste arena. The invention puts bags at the source of where they are being used. For example, in the waste industry the Speedy Bag System will be in the bottom of the receptacle, when the full bag is removed the next one to replace it is automatically discharged and ready to line the receptacle. This speeds up the process of relining the receptacle, rather than taking the extra steps to find a replacement bag that may be in a remote location like a back storeroom or cleaning cart.

Because the bags are connected at a point of weakness and packed sequentially, the next bag to be used follows the full bag being removed. After all but the last bag are used up, the last bag is attached to the container through a score in the underside of the container causing the said container to follow the last bag out of the receptacle as the last bag is removed. The container can be disposed of, recycled, or refilled.

Then a new Speedy Bag System is put into the bottom of the receptacle so that a large number of bags in a protected container will remain at the bottom of the trash receptacle for the process to be repeated.

In another embodiment, the bag dispensing apparatus comprises a container and a series of bags. The container includes a box that has a plurality of walls that define an enclosure. One of the walls defines a restricted opening. The container includes opposing walls and two of said opposing walls include connectors. A core is included with the container that attaches to the connectors. The core includes a plurality of hingedly connected plates. The connectors provide for the rotational movement of the core relative to the box. A series of bags are connected in sequence and wound around the core. The core receives and connects to the terminal end portion of a last bag of the series of bags. The core is rollable, or can be rolled, from a first planar position to a second position in which the core has an angled spiral coil shape. The second position defines a crimped connection with a terminal end portion of a last bag.

The series of bags is sequentially removable through the opening in the container. There is a line of weakness between each pair of adjacent bags to permit ease of separation between adjacent bags. The last bag and subsequent bags are rolled around the core to define the series of bags. A first position of the last bag includes the attachment between the last bag and core removing the container with the last bag. The last bag is optionally movable to a second position that includes the last bag separating from the container. When separated from the last bag, the container is suitable for refilling with the series of bags.

The connectors on the opposing walls of the container are circular notches and each notch receives a terminal end portion of the core. The crimp connection of the core includes inner and outer plates. The inner plate is outwardly biased and the outer plate is inwardly compressed to define a crimping connection on the distal end portion of the last bag. The container is preferably a four sided box with folded sides. The area covered by three of said sides being large enough to permit entry into the box of the series of bags and positioning of the terminal end portion of the core of the series of bags into the connectors in two opposing sides of the box.

The bag dispensing apparatus can also comprise a container that includes a box that has a plurality of walls. The walls define an enclosure that has a restricted opening defined in one of the walls. The box preferably has a rectangular or square shape that includes two opposed elongate first sidewalls and two opposed second sidewalls. The opposed second sidewalls each include a notch. A core connects to the notches in the container. The notches provide for rotational movement of the core relative to the box. The core includes a plurality of panels that are biased to a first position. A series of bags includes a plurality of bags that are connected in sequence. The core crimps the last bag of the series of bags between two of panels. The last bag and the subsequent bags of the series of bags are rolled around the core. The series of bags are sequentially removable through the opening in the container. A line of weakness is positioned between each pair of adjacent bags that permits ease of separation between of the adjacent bags. The apparatus is adapted for positioning on a bottom of a trashcan. Each bag of the series of bags is deployable from the container positioned on the bottom of the trashcan and each bag is adapted to extend from the container around a rim of an opening of the trashcan. The removing of each bag unwinds a subsequent bag from the core. The last bag of the series of bags is adapted to remove the container when the last bag is removed from the trashcan. The last bag is optionally separable from the container. The container is separated from the last bag and is optionally refillable with the series of bags.

The container rests on the bottom of the trash can solely by the weight of the container and series of bags. The container is a quadrangular shaped box that has four folded sides. The area covered by three of the is large enough to permit the positioning of the core of the series of bags into the notches. The opening has a first length and the core has a second length. The length of the core is greater than the length of the opening.

An additional bag dispensing apparatus comprises a container that includes a box that has a plurality of walls. The walls define an enclosure that includes a restricted opening in one of the walls. A series of bags is included in the container. The series of bags are connected in sequence. A core connects to the last bag of the series of bags. The last bag and the subsequent bags of the series of bags are rolled around the core. The series of bags is sequentially removable through said opening in the container. A line of weakness is positioned between each pair of adjacent bags that permits ease of separation between adjacent bags. The apparatus is adapted to roll the core and bags together to form the container. The core has a first planar position and includes a plurality of hingedly connected panels. The core rolls into a second position that crimps a last bag. The continued rolling of the core winds the series of bags into a roll. The removing of each bag unwinds a subsequent bag from the core. The last bag is adapted to remove the container when removed from a trashcan. The last bag is optionally separable from the container. The container is separable from the last bag and is optionally refillable with the series of bags.

The bag dispensing apparatus is an environmentally oriented system that uses recycled or recyclable materials. For example, while the box of the container is described as being of fabricated of wood-based products such as cardboard, the box can also be fabricated of alternative materials such as ceramics, recyclable polymers, metals such as aluminum and composite materials. Similarly, the bags of the present disclosure are made of biodegradable polymers.

Other details and advantages of the invention will become apparent with the following description of the embodiment and accompanying drawings.

BRIEF DESCRIPTION OF THE DRAWINGS

FIG. 5 shows a side section of the container with the first bag protruding through the top opening and the last bag protruding through the score on the underside;

FIG. 6 shows the underside of the container with score line;

DESCRIPTION OF ILLUSTRATED EMBODIMENTS

Figure 1:
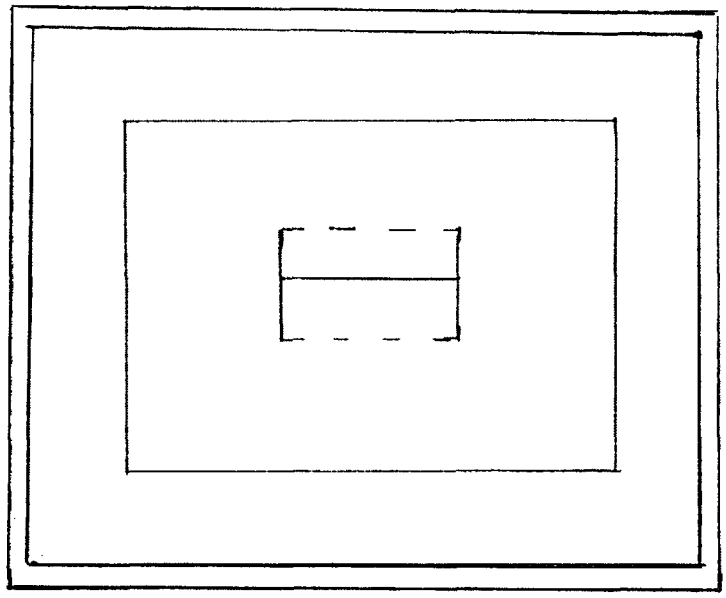
FIG. 1 shows a top view looking down into a trashcan at an unopened container of trash bags lying at the bottom of the trashcan.

Referring now more particularly to the drawings, there is shown a plan view FIG. 1. of a container holding the bags 10, resting in the bottom of a trashcan 12. The container 10 has on its top an opening 16, with two hinged doorways 18, causing the doors to fold outward from the center opening 16.

Figure 2:
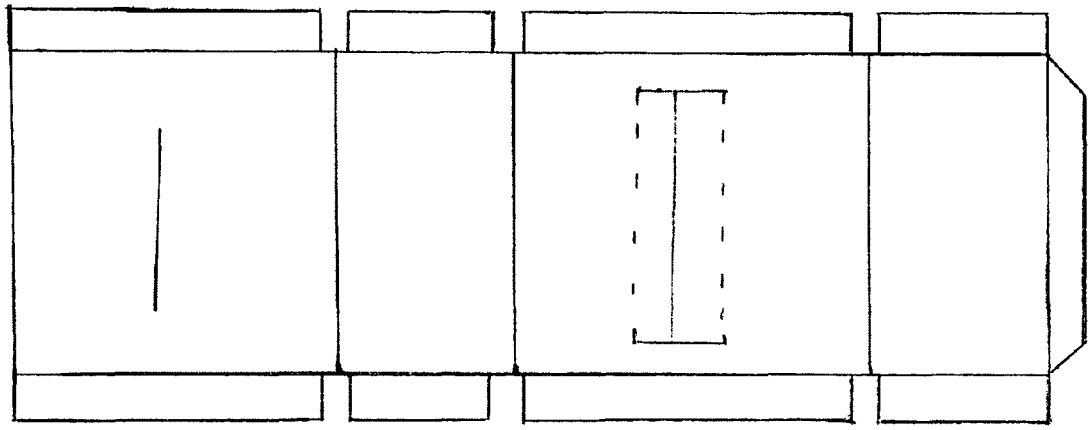
FIG. 2 is a view, in reduced scale, of a blank to form container laid out flat before it is erected.

FIG. 2. is a view of the container blank laid out flat. It has the hinged doors 18, and the cuts in the top 17, and two perforated sides 19, acting as hinges for the opening. The score 28, is what has the last bag attach to the container 10.

Figure 3:
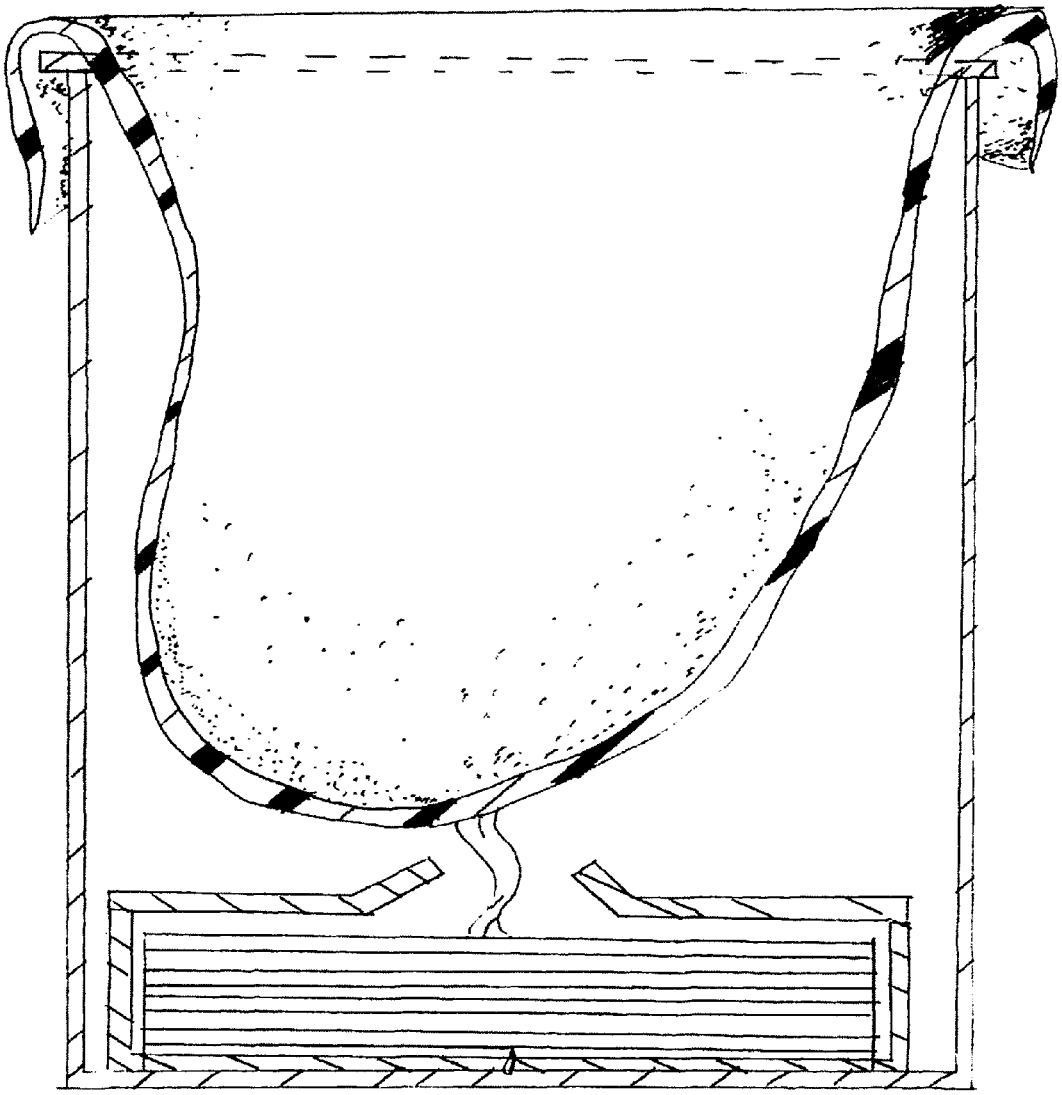
FIG. 3. shows a section corresponding to FIG. 1 of what it looks like after the container has been opened and a bag has been deployed from the container.

FIG. 3. encompasses the entire system in action where we see container 10 positioned on the bottom of the trashcan 22, a deployed bag 20 is dispensed from container 10 and bag 20 is secured around the top lid of the trashcan 22. The next sequential bag 24 is attached at the bottom of the deployed bag 20 by tear lines in the form of perforations 25, extending transversely between them. The remaining bags in the box 26 are similarly attached to each other. The last bag 27 is fed approximately ½'" through the score line in the underside of the container which then secures the bags to the container 10. Container 10 is positioned directly on the bottom of trashcan 12 and uses neither adhesives nor any other form of device to retain container 10 on the bottom of trashcan 12. The last bag 27 extending from the score line also does not include any adhesives or any other devices to retain the last bag 27 on the bottom of trashcan 12.

Figure 4:
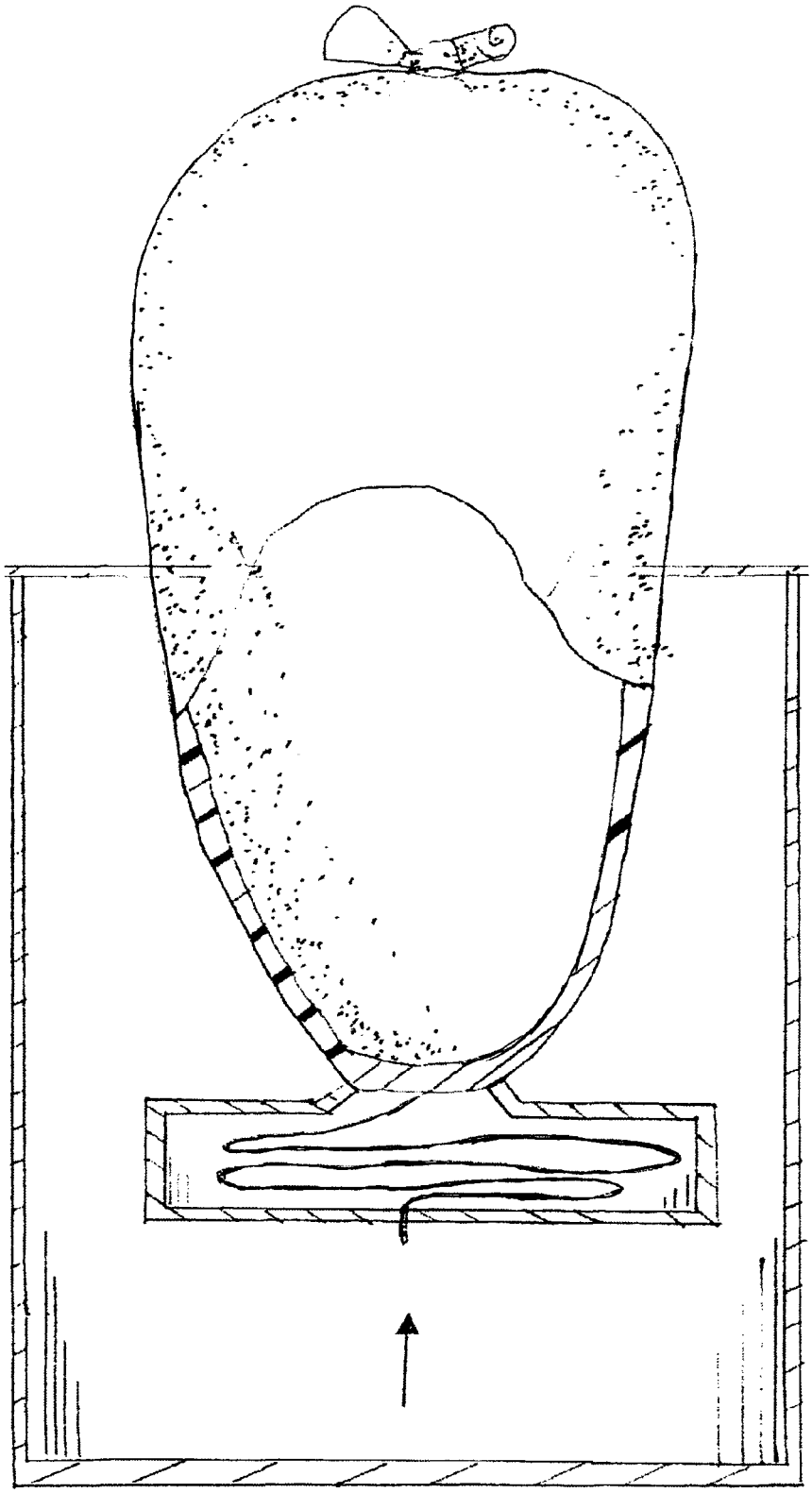
FIG. 4 shows a sectional view corresponding to FIG. 1 but showing the last bag attached to the bottom panel and protruding through the score in the container and pulling up the container in the receptacle.

FIG. 4. is a more precise view of the end of the system after all but the last bag have been used and this last bag 27, is full of trash, tied at the top 30, and being removed from the trashcan 12. The score 28, holds the last bag 27, the container 10, causing the container to be pulled up with the last bag out of the trashcan 12.

FIG. 5. is a section view of the full container 10, with the nested bags 26, and the score line 28, with the last bag 27, protruding from the lower flap.

FIG. 6. is a plan view of a container 10, bottom view showing the score line 28.

Figure 7:
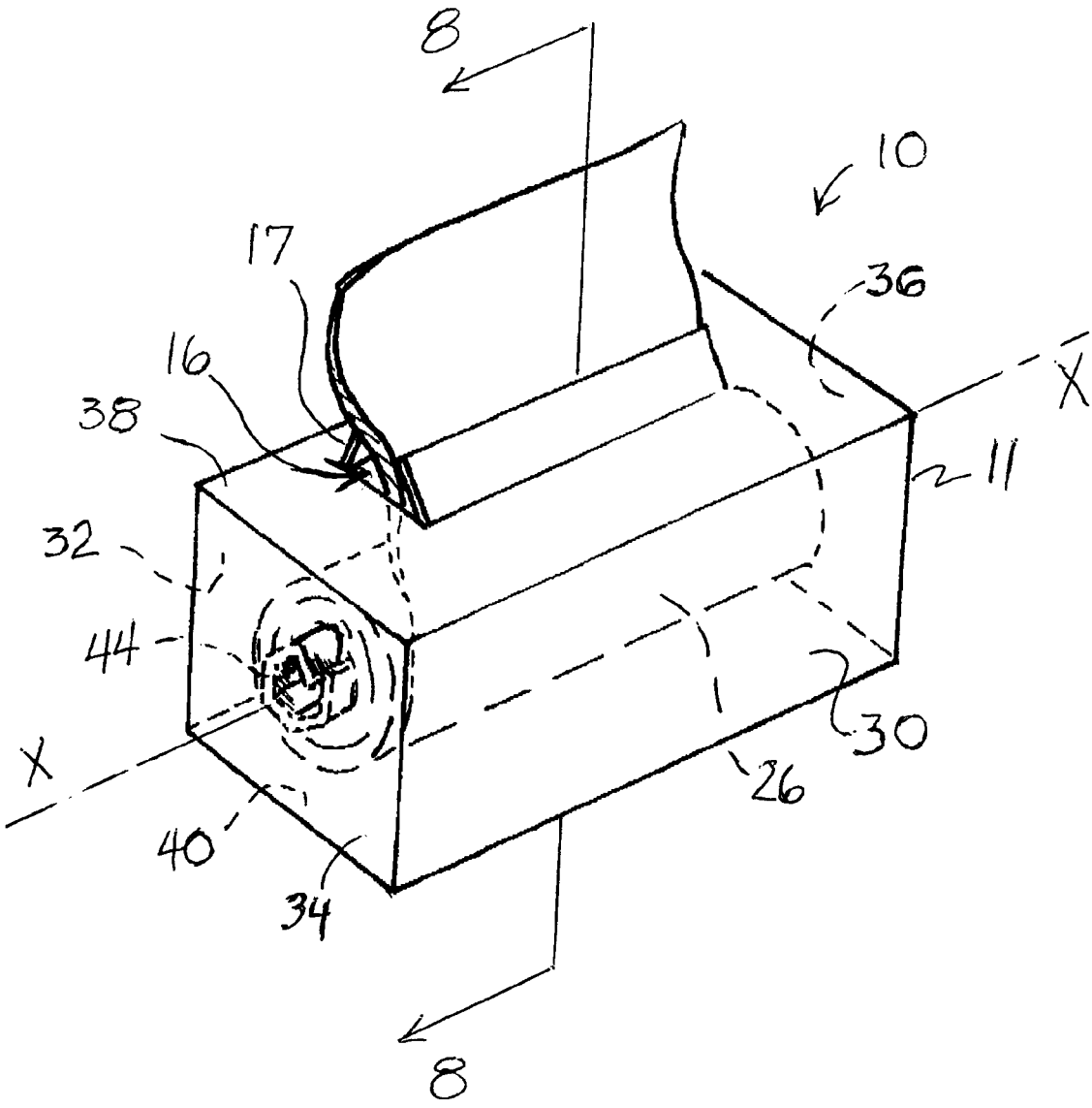
FIG. 7 is a front, side and top perspective view of a second embodiment of the container of trash bags of FIG. 1 with one bag partially deployed from the container, the container constructed in accordance with the present disclosure.

FIG. 7. is a second embodiment of the present disclosure. Container 10 is preferably a rectangular or square shaped box 11 that includes a first wall 30 opposed by a second wall 32, a third wall opposed 34 opposed by a fourth wall 36 and a fifth wall 38 opposed by a sixth wall 40. In this exemplary box, the first, second, fifth and sixth walls have a first length and the third and fourth walls have a second length that is less than the first length. Container 10 defines a central longitudinal axis-X that is approximately aligned with first wall 30, second wall 32, fifth wall 38 and sixth wall 40. Second wall 34 and third wall 36 are approximately perpendicular to the longitudinal axis.

Fifth wall 38 is shown as the top wall and includes cuts 17 that define top opening 16 as described previously. Sixth wall 40 is the bottom wall and is a solid wall that does not define an aperture to include a score or slit. Third wall 34 and fourth wall 36 are end walls. Nested or series of bags 26 is positioned in box 11 of container 10. Series of bags 26 are wound around a core 44.

Figure 8:
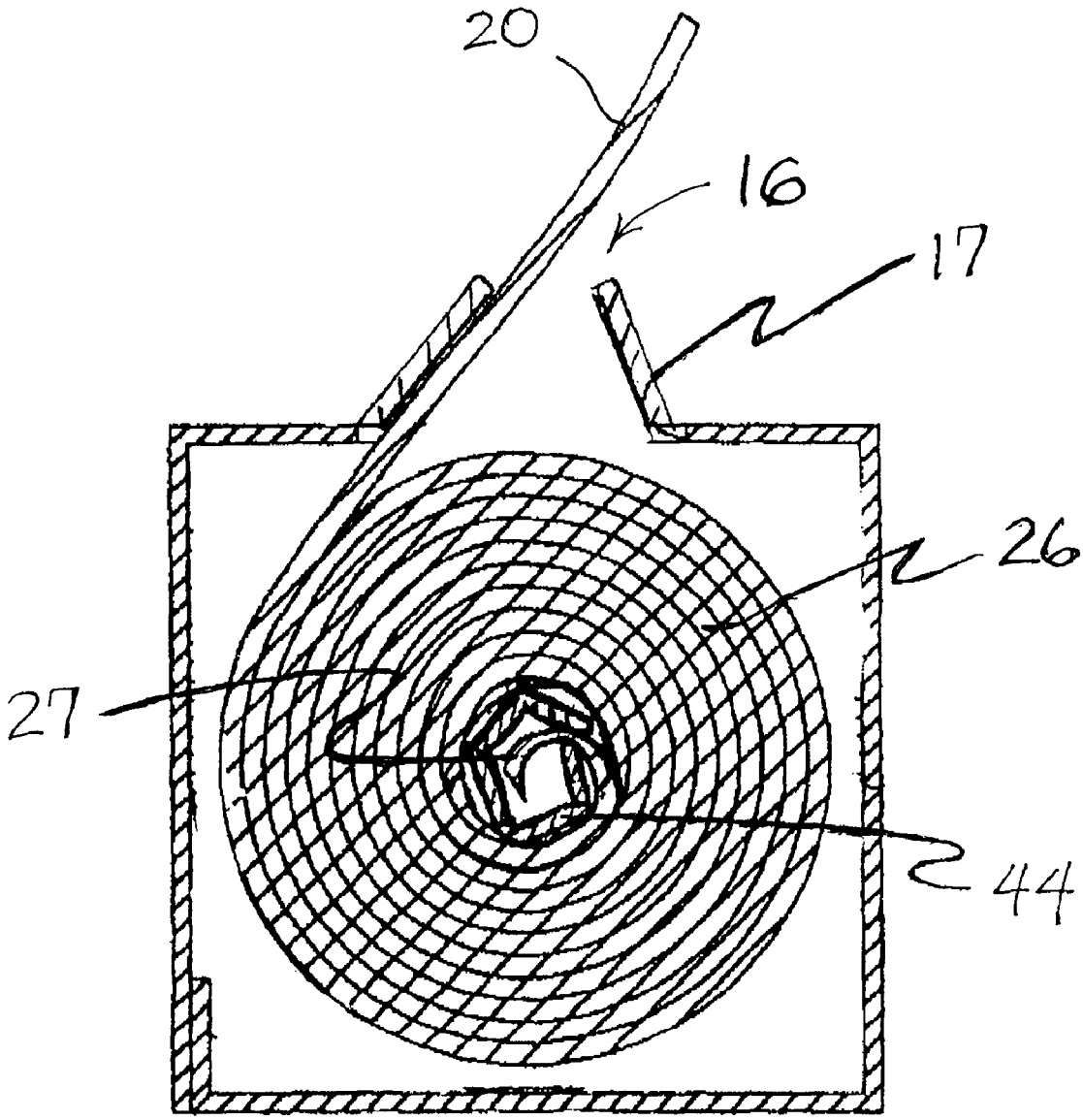
FIG. 8 is a side cross-sectional view taken along lines 8-8 of FIG. 7 that shows the series of bags wound around a core.

FIGS. 7 and 8. In this preferred embodiment, container 10 includes nested or series of bags 26 that are a combined assembly of the bags rolled around a core 44. End walls 34 and 36 include a connector 42 that couples with core 44 and provides for the rotation of core 44 relative to box 11. The at least partially deployed bag 20 extends through opening 16 defined by cut 17 in top 38 of container 10.

Core 44 is an elongate member that connects to last bag 27. Core 44 engages last bag 27 and subsequent bags, connected in series at a point of weakness as described previously. Last bag 27 and subsequent bags are rolled onto core 44 to form nested or series of bags 26. Outermost bag 20 is the first bag to be deployed from core 44.

Figure 9:
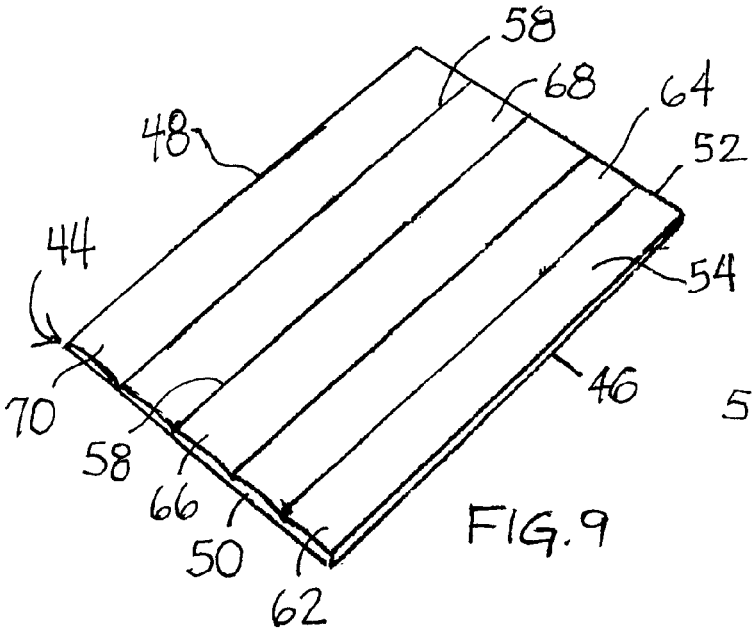
FIG. 9 is a side, front and top perspective view of the core of FIG. 8 in a first position.

FIG. 9. Core 44 has an approximately plate shape in a first position. Core 44 includes a first edge 46, a second edge 48 opposed to first edge 46, a third edge 50, and a fourth edge 52 opposed to the third edge 50. First edge 46 and second edge 48 have a third length and third edge 50 and fourth edge 52 have a fourth length that is less than the third length. Core 44 is preferably made of a wood-based recycled or recyclable product such cardboard.

Figure 10:
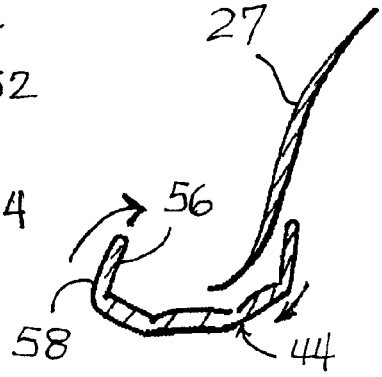
FIGS. 10-12 are side views of the core and last trash bag that shows the steps of flexing the core to the second position of a crimped last bag of the series of bags.

Core 44 has a first approximately planar side 54 and a second approximately planar side 56 (see FIG. 10). First planar side 54 includes a plurality of scores 58 that are approximately parallel to edges 46 and 48 and define approximately five elongate plates. In this preferred embodiment of core 44 there are four scores 58 that define five plates 62, 64, 66, 68 and 70. It is understood that the number of scores 58 and the plates can vary depending upon the intended application of core 44. Scores 58 provide a hinge type rotating interface between the plates and bias core 44 to the first position. As a result of scores 58, core 44 is rollable or can be rolled from the flat planar shape in the first position to an angular spiral coiled position in the second position with at least two plates overlapping one another. Scores 58 can include lines of compression or partial cuts that facilitate the relative rotation of individual plates.

Figures 11, 12:
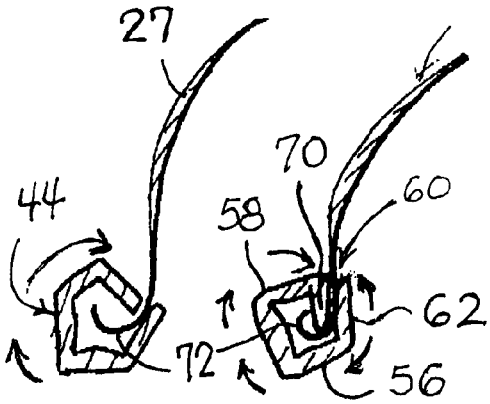

FIGS. 10-12. show the sequential steps of core 44 from the first planar position of FIG. 9 to a second position in FIG. 12. Scores 58 are constructed to facilitate the rolling of the plates of core 44 from the first position through the intermediate positions that include the approximately cupped position in FIG. 10 that can receive bottom end portion 72 last bag 27 and a curled position in which core 44 has at least partially closed on end portion 72. In a second position of core 44, the plates are rolled such that a terminal end portion 72 of last bag 27 is positioned between at least partially overlapping plates 62 and 70 which form a crimp type connection or crimp 60 on bottom end portion 72.

Figure 13:
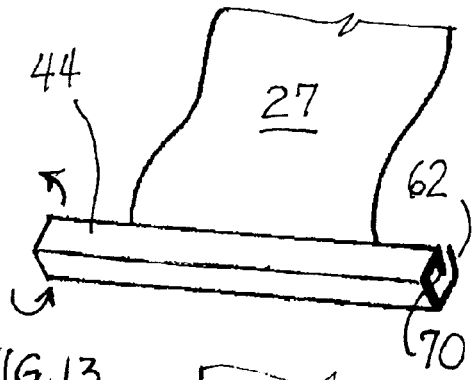
FIGS. 13 and 14 are front, side and top perspective views of the core and last bag of FIG. 12 that show the winding the trash bags onto the core.
Figure 14:
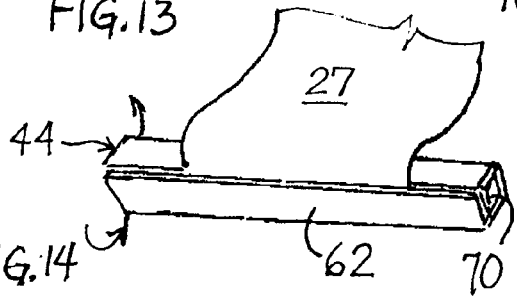

FIGS. 9, 13 and 14. Core 44 in the second position has an angled spiral coil cross-section perpendicular to the longitudinal axis (see FIG. 1) that is approximately square and crimps last bag 27 between plates 62 and 70. The crimp connection 60 of the core 44 at least includes inner plate 70 and outer plate 62, the inner plate 70 is outwardly biased as a result of scores 58 and outer plate 62 is inwardly compressed by the ongoing rolling of last bag 27 to crimp the distal end portion of the last bag. The continued rotation of core 44 in the second position from the first position continues to wind the remainder of the sequential bags around core 44.

The above method of using core 44 to connect with last bag 27 has the advantage that includes a simplified method of manufacturing that saves time and reduces costs. The rolling core 44 is an innovate relatively inexpensive component that can be readily manually manipulated to quickly create the crimping bond that is essential to the initiating of rolling of the bags. Further, this method of assembly can be readily adapted to disadvantaged people and/or people with disabilities.

Figure 15:
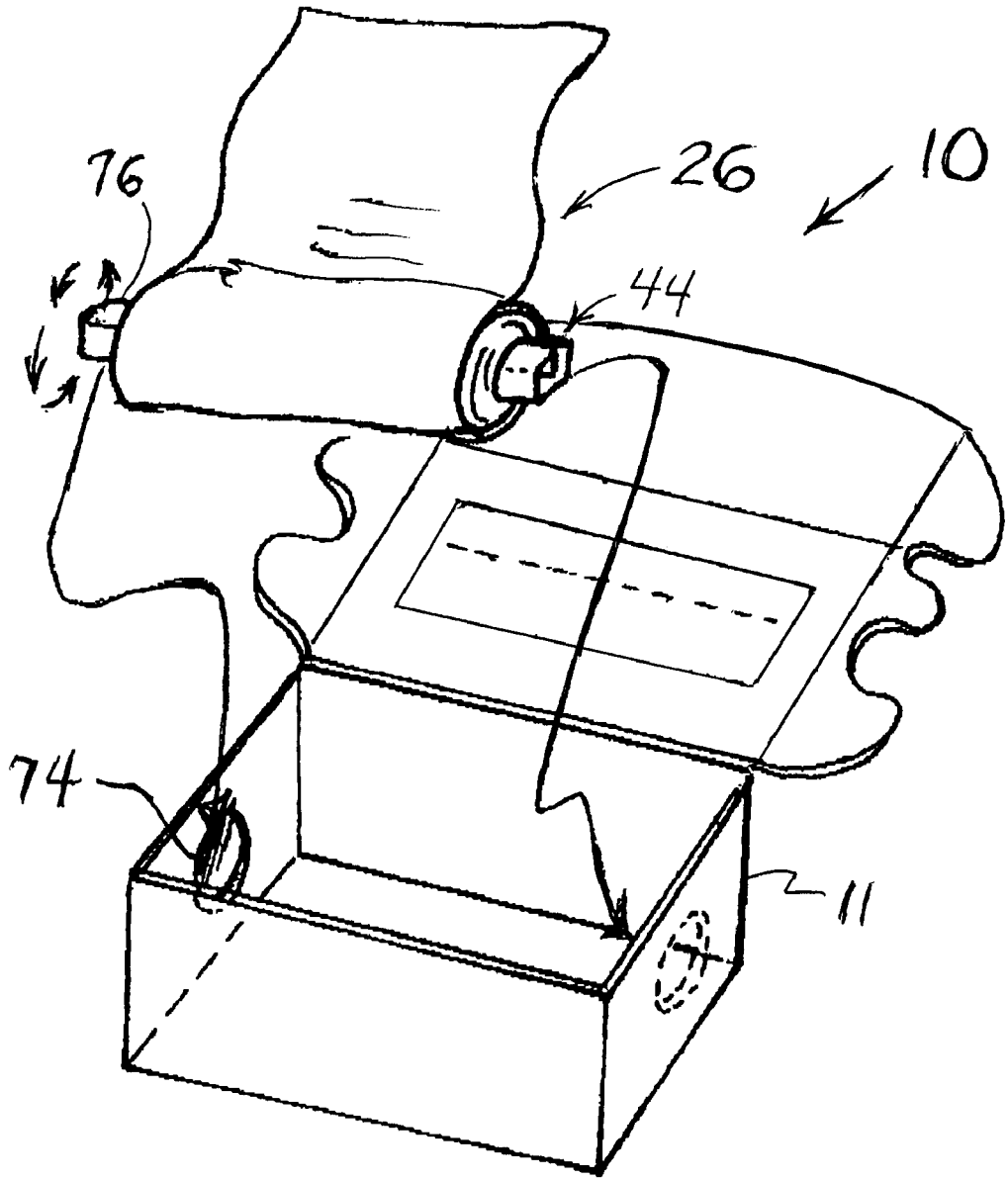
FIG. 15 is a front, side and top perspective exploded view of the container of trash bags of FIG. 7 that shows the container and a series of trash bags.

FIG. 15. Box 11 of container 10 is shown with series of bags 26 removed. Third wall 34 and fourth wall 36 define connectors 74 that are approximately aligned with the longitudinal axis (see FIG. 1) and interface with core 44. Connectors 74 are preferably circular notches defined in the surface of the inside of third wall 34 and fourth wall 36, but it is understood that connector 74 can have alternative structures such as an aperture, an axel or a separate support structure that connects to box 11, for example. Core 44 has opposed terminal end portions 76. The circular notches of connectors 74 receive the approximately square cross-sectioned terminal end portions 76. The terminal end portion 76 to connector 30 interface provides for the rotation of core 44 relative to box 11. The combined series of rolled bags 26 on core 44 is attached to connectors 74 and box 11 is closed to complete the assembly.

Alternatively, series of bags 26 with core 44 can be positioned within box 11 without receptacles 30. Series of bags 26 can rotate within the preferably elongate rectangular or square box 11 of container 10 and deploy bags. Core 44 has a length that is greater than the length of elongate cuts 17 and opening 16 in the top of container 10. This length prevents core 44 from inadvertently pulling out from box 11.

Core 44 is preferably made of wood-based products that can include cardboard, paper and/or wood composite recyclable materials. Alternatives include, for example adjoining plates connected by tape or other forms of hinge type rotating or flexing connections that can include polymer, metal or composite materials. Core 44 preferably has a square cross-section perpendicular to the longitudinal axis, but it is understood that core 44 can be a tube or take other forms such as a framework that functions to provide a core element for the connection, storage and dispensing of bags.

Figure 16:
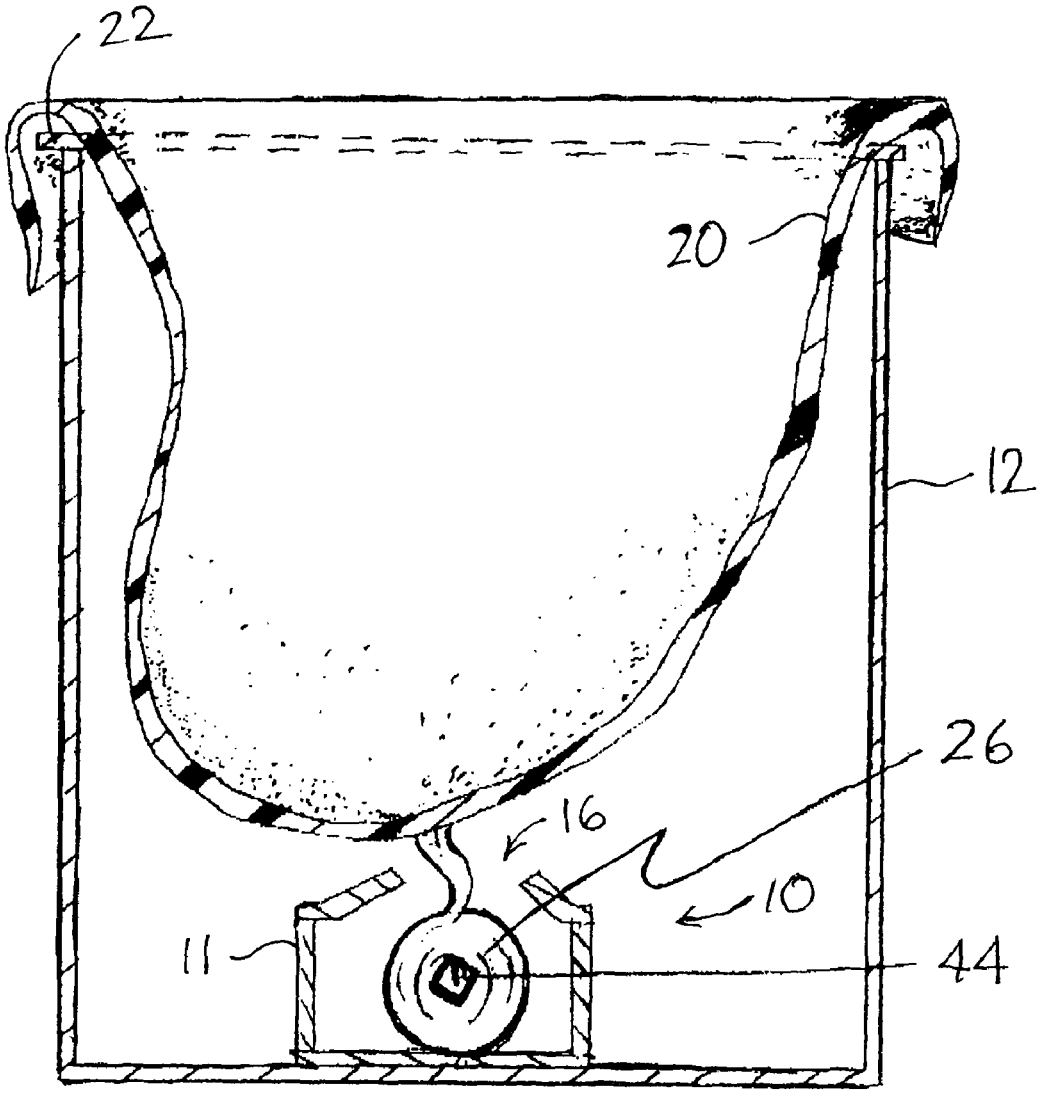
FIG. 16 is an idealized representation of a cross-sectional side view of the container of trash bags of FIG. 7 resting at the bottom of an exemplary trashcan, a bag is deployed from the container.

FIG. 16. Container 10 in operational use is positioned on the bottom of trashcan 12. This can include the partial deployment of bag 20 from opening 16 while box 11 of container 10 is dropped into trashcan 12. The opening of bag 20 is positioned around lid or edge 22 of trashcan 12. As described previously, container 10 is positioned directly on the bottom of trashcan 12 and uses neither adhesives nor any other form of device to retain container 10 on the bottom of trashcan 12.

Figure 17:
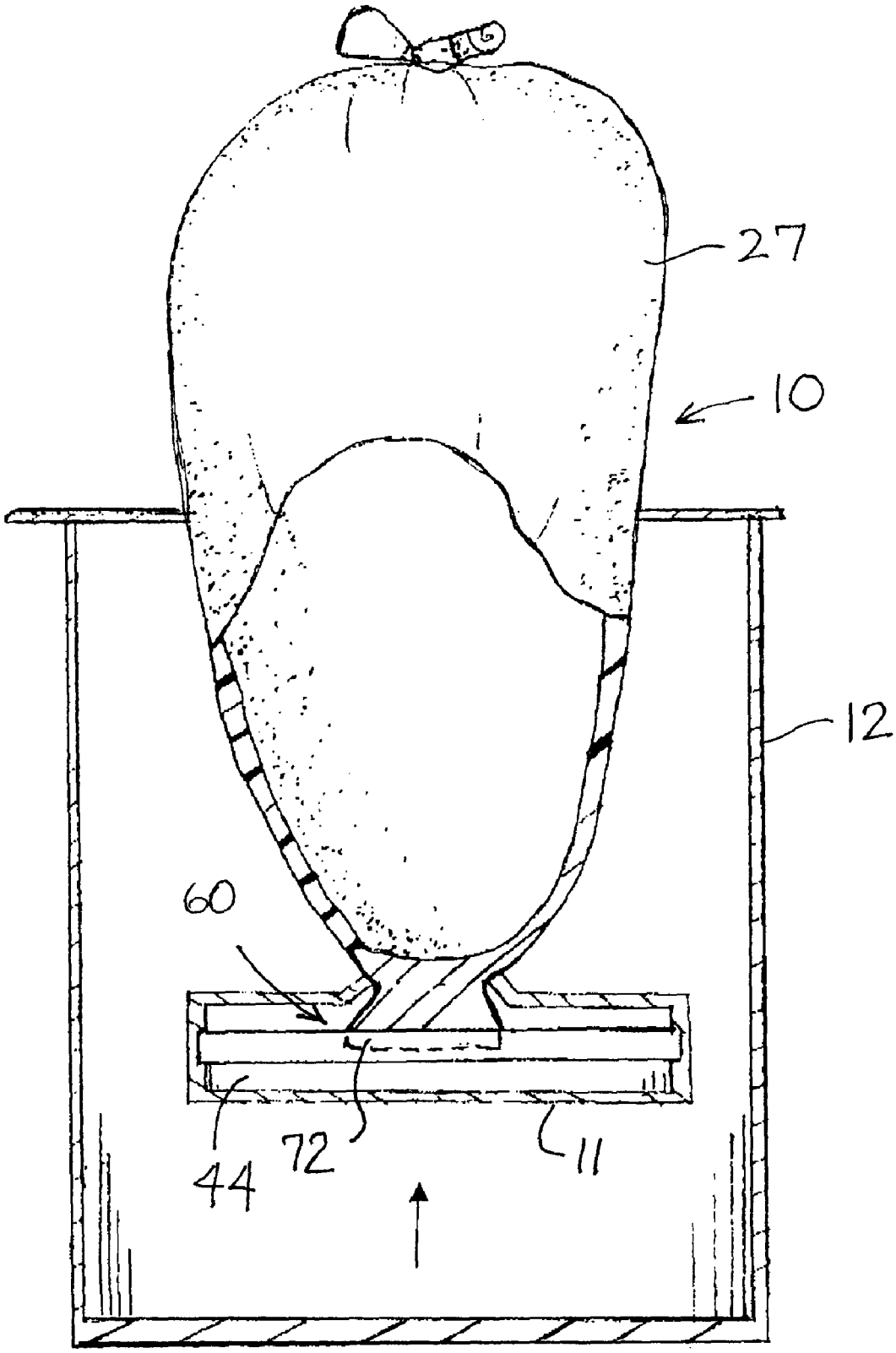
FIG. 17 is an idealized representation of a frontal view of the container of trash bags that includes a partial cross-section of the container of trash bags of FIG. 16 as the container is being removed from the trashcan with the last bag still attached to the core.

FIG. 17 When last bag 27 is removed from trashcan 12, box 11 and core 44 of container 10 are also removed. Core 44 provides crimp 60 with a sufficient bond such that when the last bag 27 is removed from trashcan 12, core 44 retains the connection with last bag 27.

Figure 18:
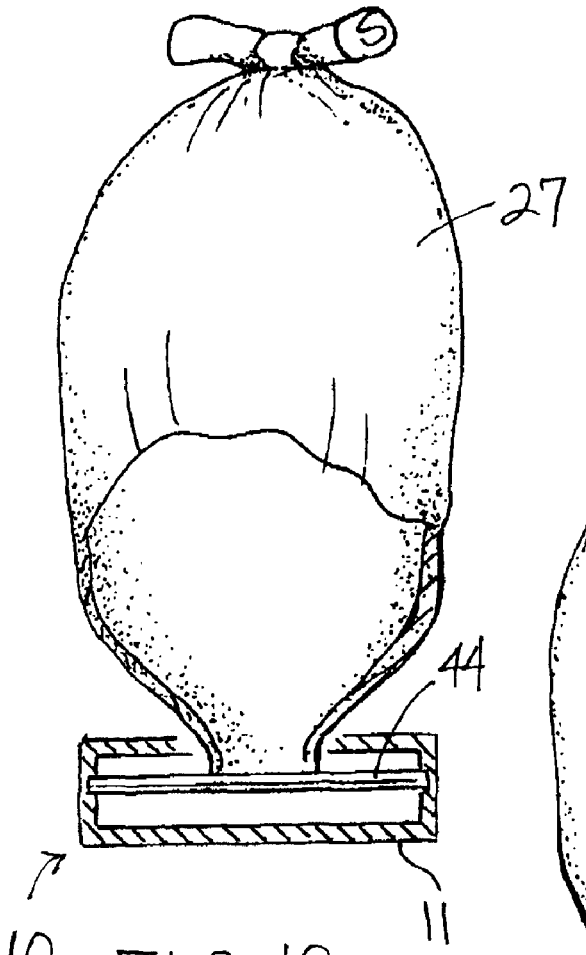
FIG. 18 is an idealized representation of the frontal view of the container of trash bags of FIG. 17 wherein the container and the last bag are still attached to the core.

FIGS. 15 and 18. Last bag 27 remains connected to and extends from core 44 in box 11 of container 10. Box 11 and core 44 can be recycled, discarded or refilled. Box 11 is preferably made of similarly recyclable material as core 44. Container 10 can be opened, core 44 removed and discarded or recycled and a series of bags 26 with core 44 positioned in connectors 74. Container 10 can then be closed to provide a secure enclosure for the retention of core 44 and series of bags 26.

Figure 19:
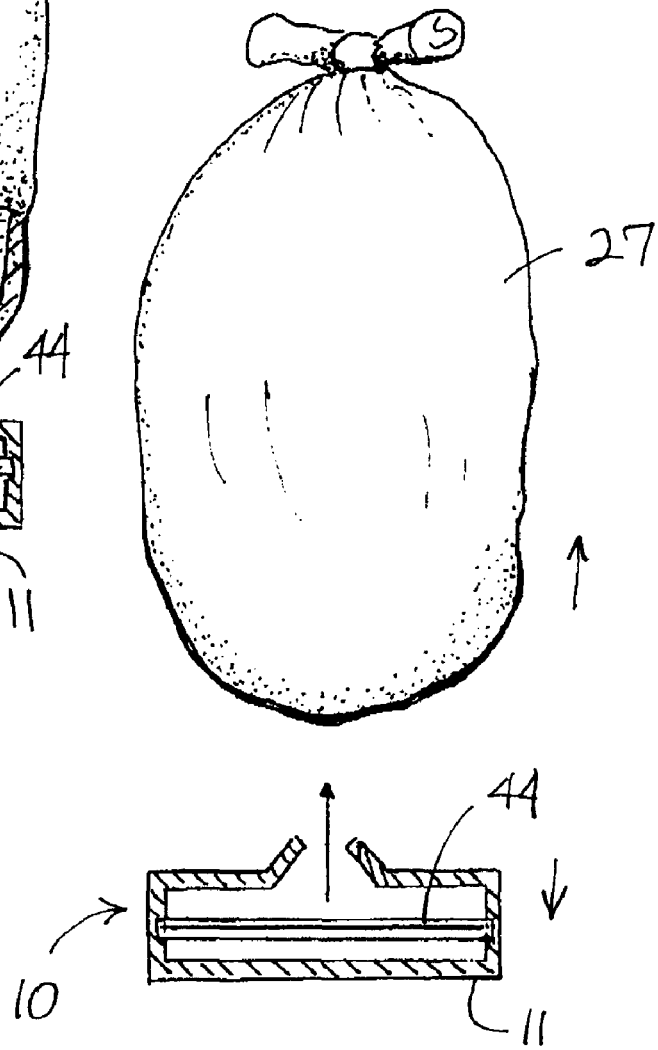
FIG. 19 is an idealized representation of the container of trash bags of FIG. 18 that shows the last bag separated from the core.

FIG. 19. Last bag 27 and core 44 remained connected until a predetermined level of force separates container 10 and bag 27. This level of force is preferably a simple additional gentle tug type motion. Core 44 remains connected to and/or positioned in box 11 after the separation of last bag 27.

Figure 20:
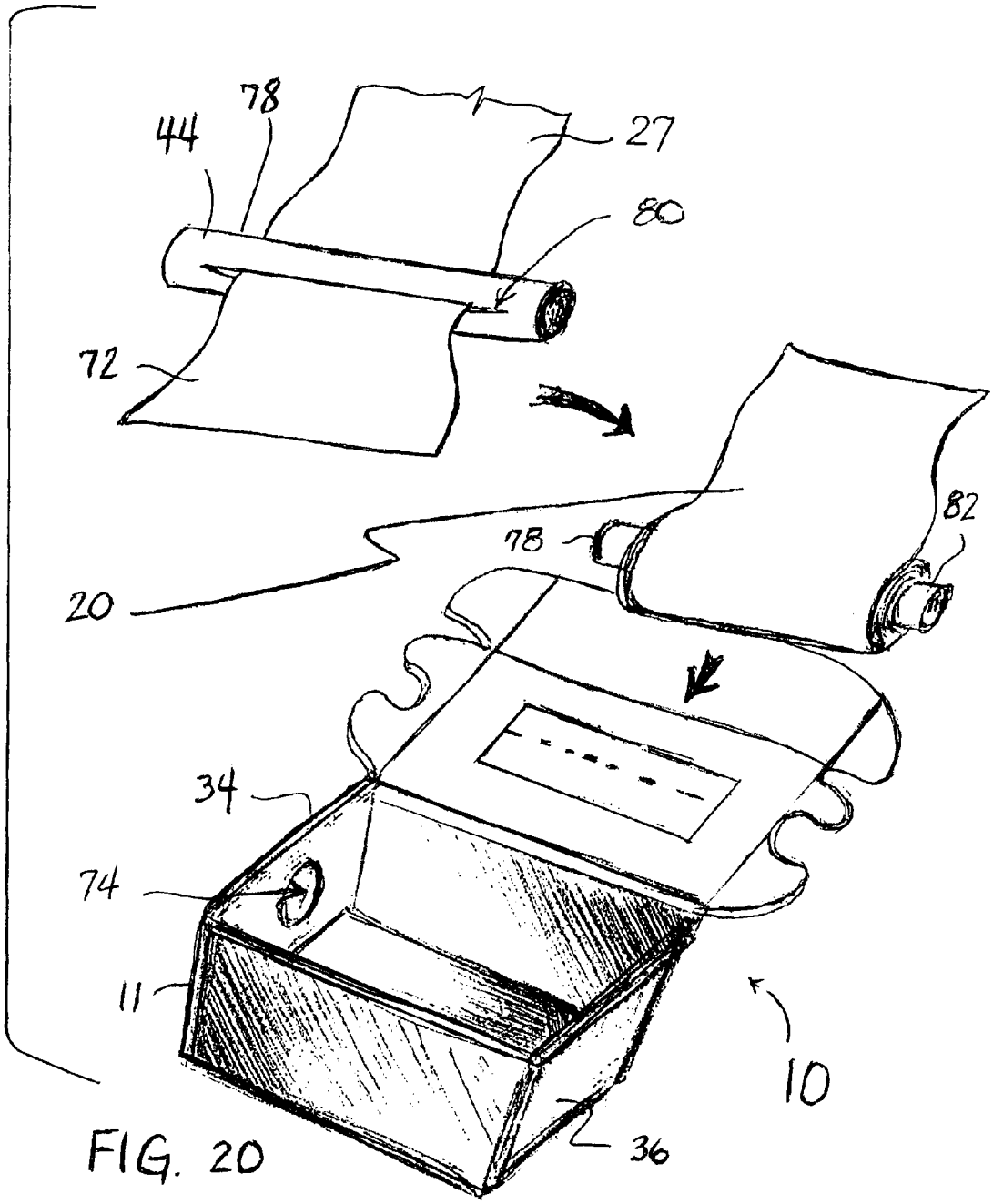
FIG. 20 is an exploded view of another embodiment of the series of bags of the container of trash bags of FIG. 1 that shows the container and a series of trash bags rolled on a spool.

FIG. 20. In another embodiment of series of bags 26, a spool 78 connects to the terminal end portion 72 of last bag 27. Spool 78 has a slit 80 parallel to the longitudinal axis (see FIG. 1) that receives at least a portion of terminal end portion 72 and functions to bind and retain last bag 27. The sequential bags from the last bag are wound around spool 78 to define series of bags 26. Box 11 defines connectors 74 in walls 34 and 36 as described previously and spool 78 has terminal end portions 82 that interface with connectors 72 for the rotation of series of bags 26 independent of box 11.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. While the present disclosure is described in terms of a series of embodiments, the present disclosure can combine one or more novel features of the different embodiments. The specification and drawings are accordingly to be regarded in an illustrative manner rather than a restrictive sense.

What is claimed is:

1. A bag dispensing apparatus that comprises:

a container that includes a box, the box has a plurality of walls that define an enclosure, a restricted opening defined in one of the walls of the container, the container includes opposing walls and two of said opposing walls include connectors;

a core included with the container that attaches to the connectors, the core includes a plurality of hingedly connected plates, the connectors provide for rotational movement of the core relative to the box;

a series of bags connected in sequence and wound around the core, the core receives and connects to the terminal end portion of a last bag of the series of bags, the core rollable from a first planar position to a second position in which the core has an angled spiral coil shape, the second position defines a crimping connection with a terminal end portion of a last bag, the series of bags sequentially removable through said opening in the container, a line of weakness between each pair of adjacent bags to permit ease of separation between adjacent bags, the last bag and subsequent bags rolled around the core to define the series of bags, a first position of the last bag wherein the attachment of the last bag and core removes the container with the last bag, the last bag optionally movable to second position that includes the last bag separated from the container, the container separated from the last bag suitable for refilling with the series of bags.

2. The bag dispensing apparatus of claim 1, wherein the connectors on the opposing walls of the container are circular notches and each notch receives a terminal end portion of the core.

3. The bag dispensing apparatus of claim 1, wherein the crimp connection of the core includes inner and outer plates, the inner plate outwardly biased and the outer plate inwardly compressed to define a crimping connection on the distal end portion of the last bag.

4. The bag dispensing apparatus of claim 1, wherein the container is a rectangular box that has four folded sides, the area covered by three of said sides being large enough to permit entry into the box of the series of bags and positioning of the terminal end portion of the core of the series of bags into the connectors in two opposing sides of the box.

5. A bag dispensing apparatus that comprises:

a container that includes a box that has a plurality of walls, the walls define an enclosure and a restricted opening defined in one of the walls of the box, the box has an approximately rectangular shape that includes two opposed elongate first sidewalls and two opposed second sidewalls, the opposed second sidewalls each include a notch;

a core connects to the notches in the container, the notches provide for rotational movement of the core relative to the box, the core includes a plurality of panels that are biased to a first position;

a series of bags connected in sequence, the core movable to a second position that crimps the last bag of the series of bags between two of the panels, the last bag and the subsequent bags of the series of bags rolled around the core, the series of bags sequentially removable through said opening in the container, a line of weakness between each pair of adjacent bags to permit ease of separation between adjacent bags, the apparatus adapted for positioning on a bottom of a trashcan, each bag of the series of bags deployable from the container positioned on the bottom of the trashcan and each bag adapted to extend from the container around a rim of an opening of the trashcan, the removing of each bag unwinding a subsequent bag from the core, the last bag adapted to remove the container when removed from the trashcan, the last bag optionally separable from the container, the container separated from the last bag optionally refillable with the series of bags.

6. The bag dispensing apparatus of claim 5, in which the container rests on the bottom of the trashcan solely by the weight of the container and series of bags.

7. The bag dispensing apparatus of claim 5, in which the box has four folded sides, the area covered by three of said sides being large enough to permit the positioning of the core of the series of bags into the notches.

8. The bag dispensing apparatus of claim 5, wherein the opening has a first length and the core has a second length and the length of the core is greater than the length of the opening.

9. A bag dispensing apparatus that comprises:

a container that includes a box, the box has a plurality of walls that defines an enclosure, a restricted opening defined in one of the walls of the container;

a series of bags included in the container and positioned in the box, the series of bags connected in sequence, a core connects to the last bag of the series of bags, the last bag and the subsequent bags of the series of bags rolled around the core, the series of bags sequentially removable through said opening in the container, a line of weakness between each pair of adjacent bags to permit ease of separation between adjacent bags, the apparatus adapted to roll together to form the container, the core has a first planar position and includes a plurality of hingedly connected panels, the core rolls into a second position that crimps a last bag, the continued rolling of the core winds the series of bags into a roll, the last bag adapted to remove the container when removed from a trashcan, the last bag optionally separable from the container, the container separated from the last bag optionally refillable with the series of bags.

10. The bag dispensing apparatus of claim 9, wherein the box includes two opposed elongate first sidewalls and two opposed second sidewalls that define a rectangular enclosure, the opposed second sidewalls each include a notch in the sidewall.

11. The bag dispensing apparatus of claim 9, wherein the core connects to the notches in the box, the notches provide for rotational movement of the core relative to the box.

12. The bag dispensing apparatus of claim 9, wherein the core provides a crimp connection to the last bag.

* * * * *